US005358377A

United States Patent [19]

Wright et al.

[11] Patent Number: 5,358,377

[45] Date of Patent: Oct. 25, 1994

[54] SYSTEM AND METHOD FOR SUPPORT AND ROTATION OF VOLUME

[75] Inventors: Tommy D. Wright, Irving; Felix Garcia, Round Rock; Rodney D. Williams, Plano, all of Tex.

[73] Assignee: Texas Instruments Incorporated, Dallas, Tex.

[21] Appl. No.: 879,514

[22] Filed: May 4, 1992

Related U.S. Application Data

[63] Continuation of Ser. No. 563,180, Aug. 6, 1990.

[51] Int. Cl.[5] ..... F04D 29/00

[52] U.S. Cl. ..... 415/165; 415/122.1; 415/124.2; 415/186; 415/202; 40/431; 40/441; 250/231.14; 359/522; 359/893

[58] Field of Search ..... 415/80–82, 415/122.1, 124.2, 151, 159, 165, 167, 185, 186, 202; 343/766, 882; 352/43, 86; 40/427, 429–431, 439–441; 350/99, 322, 583, 584; 250/231.13, 231.14; 310/82, 83, 90; 52/65, 66

[56] References Cited

U.S. PATENT DOCUMENTS

| | | | |
|---|---|---|---|
| 827,165 | 7/1906 | Mariner | 415/186 |
| 1,223,459 | 4/1917 | Whitney . | |
| 1,794,103 | 2/1931 | Cubitt . | |
| 2,589,569 | 3/1952 | Peter et al. . | |
| 2,595,912 | 5/1952 | Alford | 343/766 |
| 3,092,075 | 6/1963 | Hosokawa | 52/65 |
| 3,381,422 | 5/1968 | Olson | 52/66 |
| 3,471,641 | 10/1969 | Baker et al. . | |
| 3,549,800 | 12/1970 | Baker . | |
| 3,561,006 | 2/1971 | Humphreys | 310/82 |
| 3,604,009 | 9/1971 | Behnke | 343/766 |
| 3,682,553 | 8/1972 | Kapany . | |
| 3,757,106 | 9/1973 | Bau et al. . | |
| 3,825,335 | 7/1974 | Reynolds . | |
| 3,825,336 | 7/1974 | Reynolds . | |
| 3,855,755 | 12/1974 | Burdick . | |
| 3,970,361 | 7/1976 | Di Matteo et al. . | |
| 4,130,832 | 12/1978 | Sher . | |
| 4,475,110 | 10/1984 | Hutchins | 343/882 |
| 4,535,394 | 8/1985 | Dugre . | |
| 4,746,791 | 5/1988 | Forkel | 250/231.13 |
| 4,871,231 | 10/1989 | Garcia, Jr. . | |
| 4,993,659 | 2/1991 | Takai et al. | 250/231.13 |

FOREIGN PATENT DOCUMENTS

| | | | |
|---|---|---|---|
| 2133214 | 7/1971 | Fed. Rep. of Germany . | |
| 1242847 | 4/1960 | France | 52/65 |
| 1532474 | 5/1967 | France . | |
| 0431287 | 1/1975 | U.S.S.R. | 52/65 |
| 0667656 | 6/1979 | U.S.S.R. | 52/65 |

OTHER PUBLICATIONS

07/409,167 Garcia, Jr. Real Time Three Dimensional Display and Method.

*Primary Examiner*—Edward K. Look
*Assistant Examiner*—Christopher Verdier
*Attorney, Agent, or Firm*—Rene' E. Grossman; Richard L. Donaldson

[57] ABSTRACT

There is disclosed a system and method for rotationally controlling a circular structure, such as a dome, from the outer circumference of the dome. The system uses an air driven motor having a circular fixed section and a movable section. The movable section is attached to the rim of the dome and is supported by pressurized air over the fixed section. Air, or other fluid, is used to drive the movable section, and hence the dome, around the circle. The dome speed is controlled by air pressure and the position of the dome is monitored.

22 Claims, 5 Drawing Sheets

FIG. 11
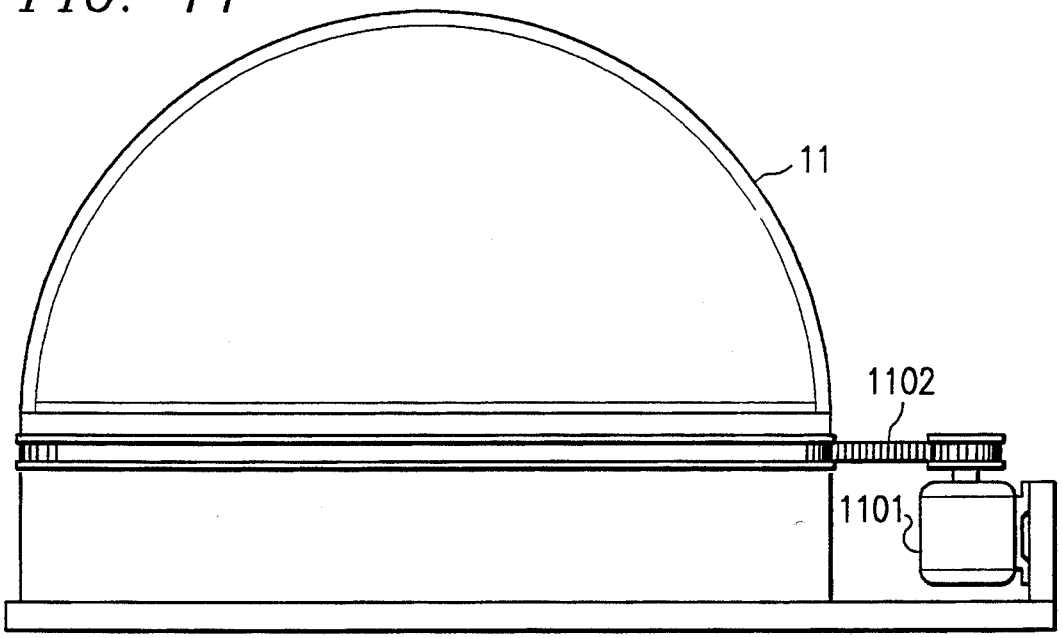
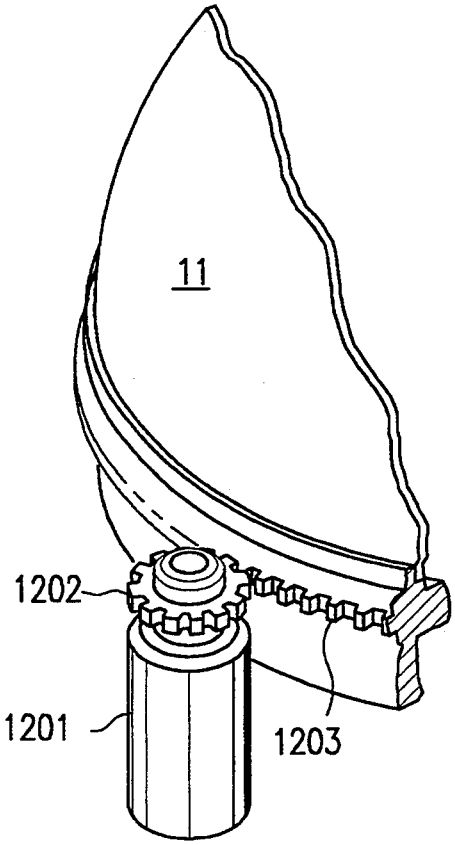
FIG. 12

SYSTEM AND METHOD FOR SUPPORT AND ROTATION OF VOLUME

RELATED APPLICATIONS

This application is a continuation of application Ser. No. 07/563,180 filed Aug. 6, 1990, entitled "A System and Method for Support and Rotation of Volume" by Tommy D. Wright, Rodney D. Williams and Felix Garcia, now abandoned.

TECHNICAL FIELD OF THE INVENTION

This invention relates to rotational object support and control and more particularly to a system and method of precisely controlling a rotating surface by applying rotational force at its periphery.

RELATED APPLICATIONS

All of the following patent applications are cross-referenced to one another, and all have been assigned to Texas Instruments Incorporated. These applications have been concurrently filed and are hereby incorporated in this patent application by reference.

- Attorney Docket #TI-15405 A System and Method for Support and Rotation of an Object, U.S. patent application Ser. No. 563,180;
- Attorney Docket #TI-15406 Linear Stepper Motor Design and Method of Operation, U.S. patent application Ser. No. 563,238;
- Attorney Docket #TI-15407 Apparatus and Method for Volume Graphics Display, U.S. patent application Ser. No. 563,372;
- Attorney Docket #TI-15408 Volume Display Development System, U.S. patent application Ser. No. 563,374; and
- Attorney Docket #TI-15409 Volume Display Optical System and Method, U.S. patent application Ser. No. 563,370.

BACKGROUND OF THE INVENTION

A relatively new display system has been developed which generates images in all three physical dimensions. The system relies on the generation within a confined space, typically, a closed dome, of a volume upon which coherent light impacts to create the images. Each image is comprised of a number of light pixels (called voxels) usually generated by one or more laser beams impacting on the generated volume within the dome.

The defined volume can be created by spinning a helix shaped surface (disk) within the dome so that as the disk spins a volume is created defined by the disk surface as it moves up and down in a helical curve. Thus, at any point in time a different height of the volume is at a given physical location within the dome. A light spot can then be created by impacting a beam of coherent light with the disk at a particular point in time coinciding with the height desired for that point of light. By timing a large number of such light beams, three dimensional objects can be created within the dome and these objects then can be viewed from any position since the spinning disk (which creates the display volume) is essentially transparent to the eye. Such a system is the subject of U.S. patent application Ser. No. 07/409,176.

A number of problems become clear. It is desired to spin a physical object at 600 rpm. One problem is how to mount the disk. The simple solution, of course, is to mount it on a center shaft and use a motor to spin the disk to create the volume spacer. However, this will only allow images to be created at the outside edge of the disk.

One objective of the invention is the creation of a fully addressable display volume. A fully addressable display volume is a volume in which displays can be created anywhere within the space cylinder. Another objective is to create a very stable disk. A stable disk is one that does not have excessive dynamic movement over time and that does not have excessive vibration. A further objective is the ability to know precisely where any point on the disk is at any point in time.

Originally, a flat disk mounted on a shaft of a motor was used. It was found that air turbulence, vibration, and other aspects limited the resolution and the precision of such a display system.

Accordingly, there exists a need in the art for a rotational system that creates a fully addressable volume and which is dynamically stable and which lends itself to precise monitoring.

SUMMARY OF THE INVENTION

We have solved the problem of making a disk rigid as it spins. This is accomplished by fusing a disk inside a dome using the side edge of the disk for attachment to the dome. Using this approach, the dynamic movement of the edges is eliminated.

The outer rotation rim of the dome is, in one embodiment, supported either pneumatically or magnetically, and rotated by a pneumatic drive. The pneumatic support is an air channel that creates a blanket of air directed to the bottom of the dome. The dome floats a few thousandths of an inch above the base structure. The pneumatic drive then rotates the dome by blowing a directed jet of air against a reflecting surface on the dome edge.

In summary, there are three aspects of the invention. One is the support of the disk and the dome structure combination. The second is the actual rotation of that combination around an axis. The third is the shaft encoding, or optical encoding, to determine where the disk is in its rotation.

It is one technical advantage of this invention that a rotating disk is positioned within a defined structure, such as a dome, mechanically attached to the circumference of the dome, and made to rotate in conjunction with the rotation of the dome.

It is another technical advantage of this invention to provide such a system where the rotation of the disk is precisely controlled by pneumatic means.

BRIEF DESCRIPTION OF THE DRAWINGS

The foregoing objects, features and technical advantages, as well as others, of the invention will be more apparent from the following description of the drawings in which:

FIGS. 11 and 12 show alternate embodiments of the invention.

DETAILED DESCRIPTION OF THE INVENTION

Figure 10:
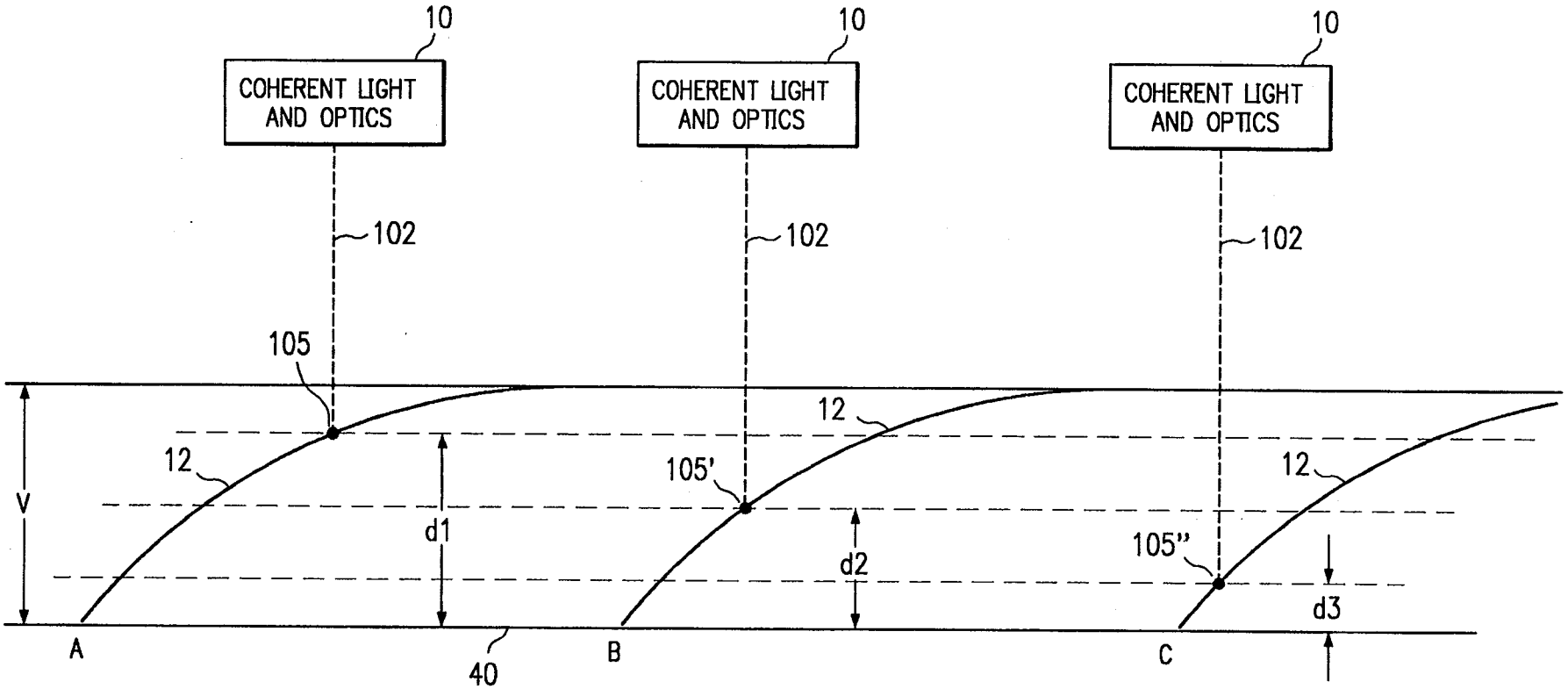
FIG. 10 shows an illustration of the volume created by a helix shaped surface.

Before beginning a discussion of the optic system, a brief overview of the manner in which images are created in a defined volume is appropriate. Such a discussion is with respect to FIG. 10 where surface 12, which in one embodiment can be a spinning helix, defines a volume V as it rotates about some central point. Each point in time A, B and C shows the helix at the same physical (spatial) place but at a slightly different time. Since the helix, or double helix in another embodiment, is spinning at a rate of 600 rpm or more, the human eye will treat the surface as being transparent. It is this transparency that allows the creation of three-dimensional images when struck by coherent light.

Thus, coherent light source and optics system 10, discussed in more detail in concurrently filed patent application entitled "Volume Display Optical System and Method" Ser. No. 563,370 provides a pulse of light 102 which has been spatially positioned and timed such that it impacts with surface 12 to form a point of light 105 at a height d1 from a base line 40. This pulse could be timed to arrive a little later in time and then it would impact surface 12 to create point of light 105′ which is displaced from base line 40 at a height of d2. Still further delay in the beam 102 would result in a point of light 105″ at a height of d3 from base line 40.

Using this technique, then, and understanding that light source 10 can deliver multiple light beams over a wide spatial range at each point in time, three dimensional images can be formed from the points of light. Because the spinning helix is transparent to the human eye, the light spots will appear to be free floating and can be viewed from any angle and from any side.

Figure 1:
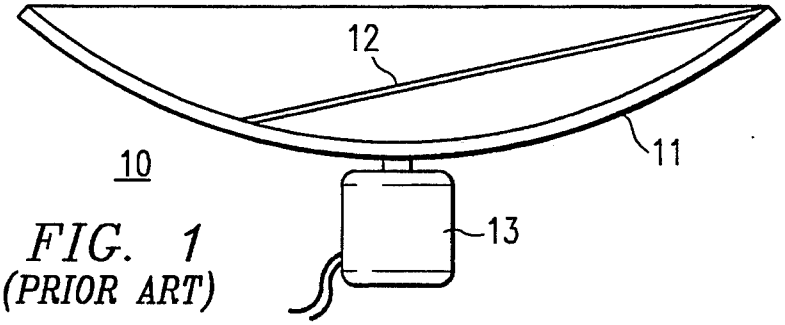
FIG. 1 (PRIOR ART)
FIG. 1 shows an illustration of a surface creating a defined volume within the dome.

FIG. 1 shows system 10 having disk 12 fused inside of inverted dome 11. Disk 12 is actually a flat circular disk that rotates to define the volume as discussed above. Motor 13 rotates the combined disk and dome.

Figure 2:
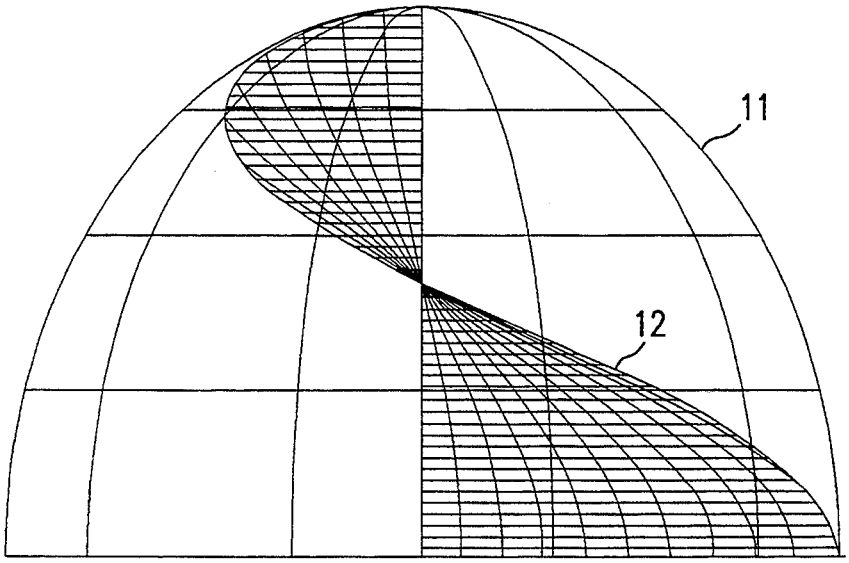
FIGS. 2–4 show graphically the volumes created by the rotating surface.

FIG. 2 shows dome 11 in actual contact with disk 12. Disk 12 illustrates the viewing area defined by the tangency of dome 11 and disk 12. Disk 12 is a helix in this embodiment.

Figure 3:
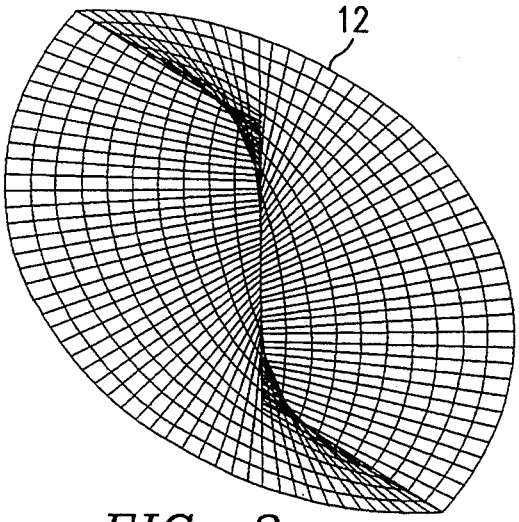

FIG. 3 shows a top view of disk 12. Disk 12 is a double helix in this embodiment.

Figure 4:
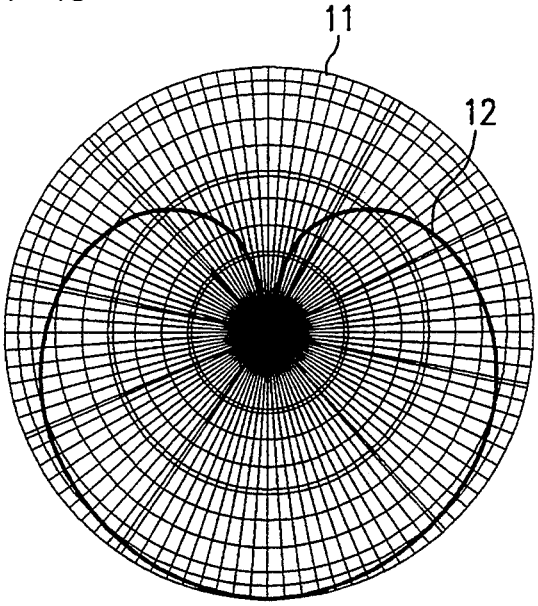

FIG. 4 is the geometric design of a two foot rise disk 12. Rise is the amount of volume that can display an image. This figure represents the vertical elevation of the disk at the highest point as a radial distance.

FIGS. 5–9 show a system for rotating a dome including a dome having a circumferential edge for controlling the rotation, a stationary member having included therein a fluid controlled cushioning member, the stationary member having a radius of curvature matching the radius of curvature of the circumferential edge, a movable member slidably engaged to the stationary member and responsive to fluid directed to the movable member for moving along the curved radius of the stationary member under control of the fluid, and a coupling member for connecting the circumferential edge of the dome to the movable member.

Figure 5:
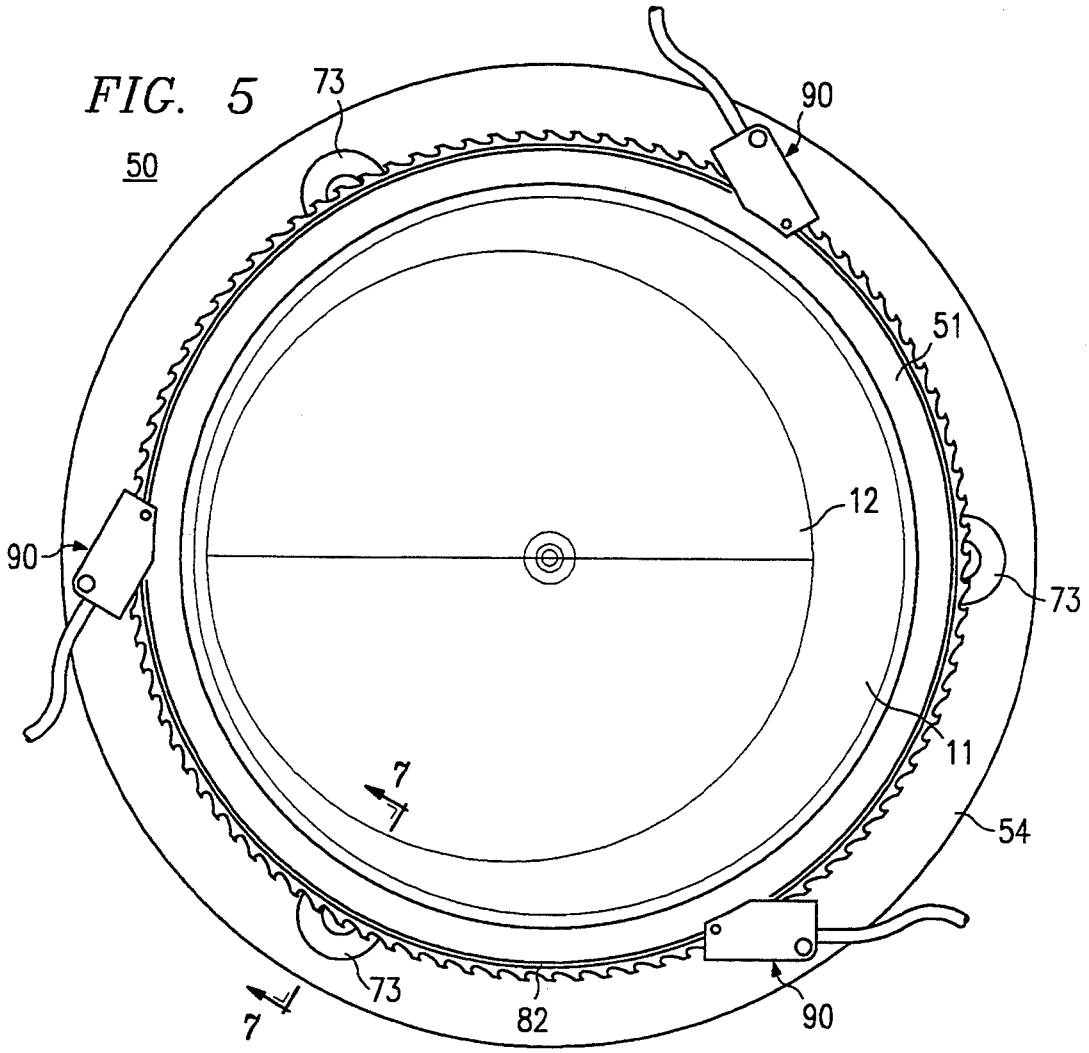
FIGS. 5–6 show top and front views, respectively, of a rotating dome system using this invention.

FIG. 5 shows a top view of the new dome rotating system 50 being rotated by mechanism 54 which is an air activated system. This system is partially balanced centrifugally as will be seen by wheels 73 equally spaced around the circumference of dome 11. Inside dome 11 surface 12 rotates as previously discussed to form the volume space.

Air activation is controlled by selectively applying air to activator 90 that can be spaced around the circumference of system 50.

Figure 6:
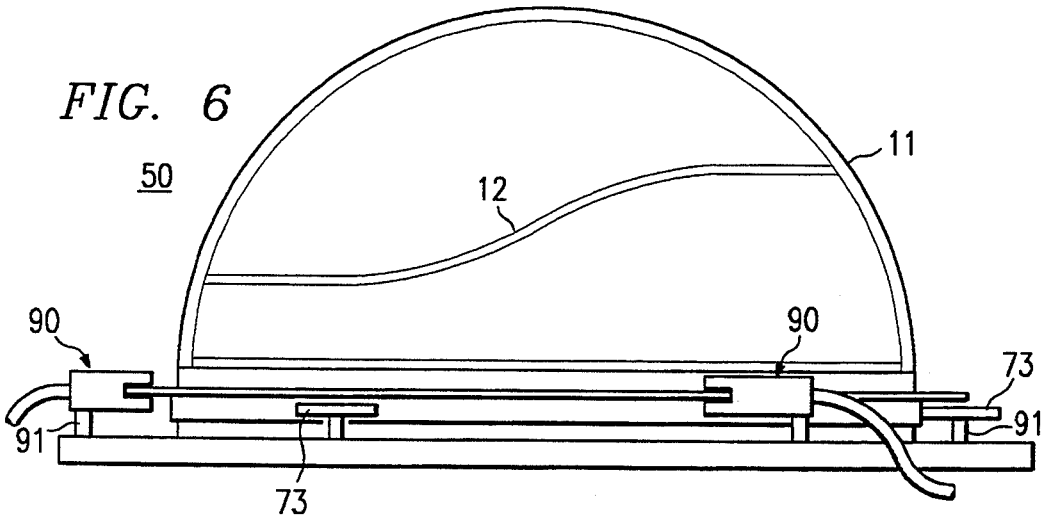

FIG. 6 is a front view of system 50. Surface 12 is fused to dome 11, and rotates with the dome to create the defined volume.

Figure 7:
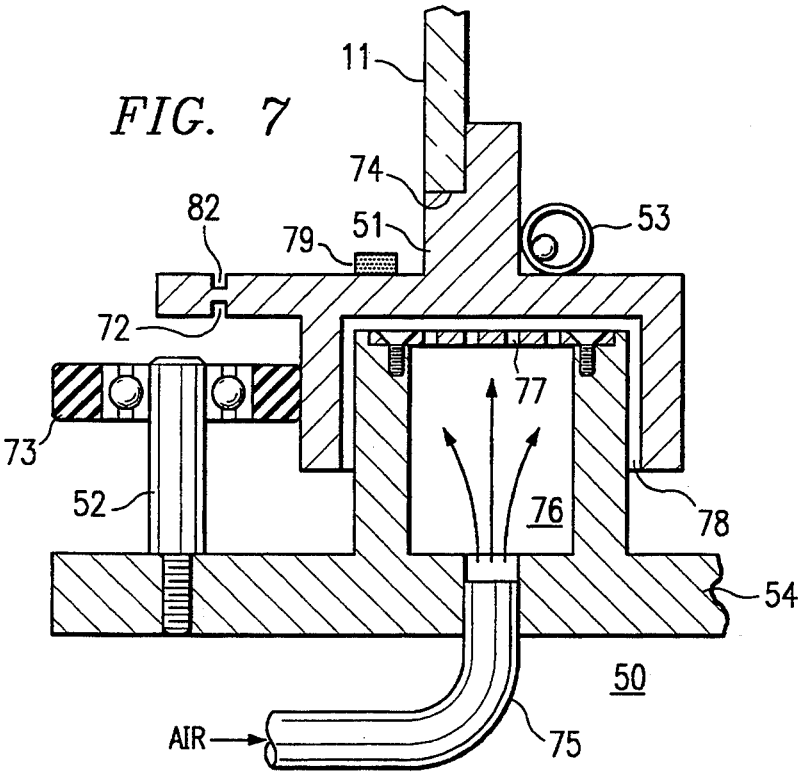
FIG. 7 shows details of a section 7—7 taken through the dome system of FIG. 5.

FIG. 7 is a sectional view taken through section 7—7 of FIG. 5. Air cavity 76 allows air via input 75 to be fed around the perimeter of system 50 and contains multiple air holes 77 in this cavity to support tram 51. Tram 51 travels rotationally around circular support 54 supported by a thin layer of air.

Tram 51 is connected to dome 11 by slot 74 and travels with the dome to rotate the dome. Rubber coated support wheels 73 are mounted on shaft 52 which are positioned around the outside perimeter of tram 51. Centrifugal ball balancing system 53 balances dome 11 and tram 51 assembly in rotation. Also shown is magnet 79.

Figure 8:
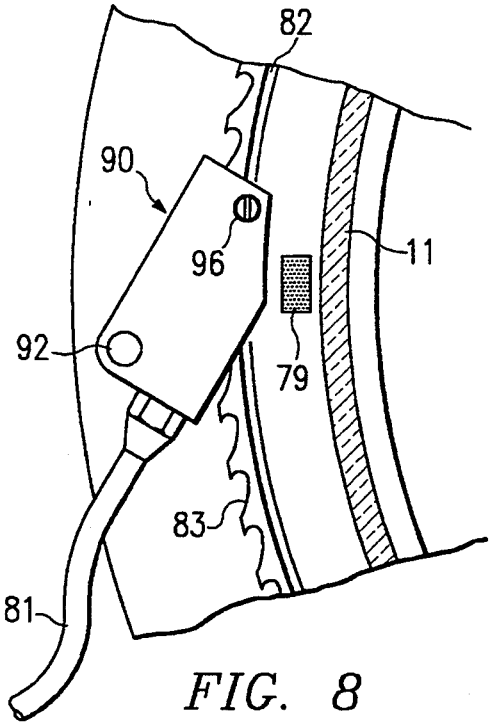
FIG. 8 shows details of the air activator and drive mechanism of the dome system.

As shown in FIG. 8 activator 90, which is shown in more detail in FIG. 9, is connected to tram 51 by screw 96 positioned through activator 90 into groove 82 of tram 51. Air, via hose 81, is selectively injected into activator 90 for impact onto buckets 83 on the periphery of tram 51, thereby propelling tram 51 rotationally around support 54. Activator 90 is maintained in position via post 91 fitted through hole 92. Post 91 shown in FIG. 9 is supported as shown in FIG. 6 by base 54 shown in FIG. 6.

Figure 9A:
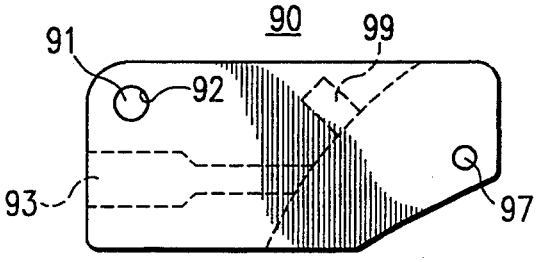
FIGS. 9*a–b* show an exploded view of the activator.
Figure 9B:
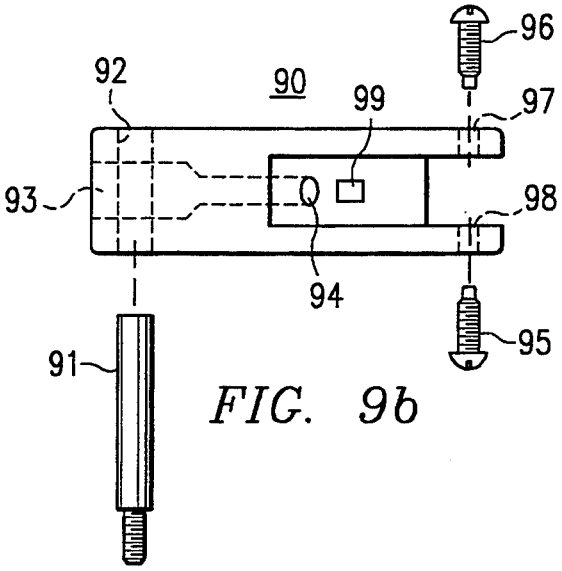

Turning now to FIG. 9*a*, activator 90 mounts on post 91 via hole 92 and air is injected via orifice 93 and is ejected via port 94 to impact on bucket 83 on the rim of tram 51, as shown in FIG. 8. As seen in FIG. 9*b*, screws 96 and 95 fit through holes 97 and 98, respectively, to engage groove 82 and 72 (not shown) of tram 51. Slots 82 and 72 are shown in FIG. 8.

Thus, as shown in FIG. 8, as air is applied to activator 90, tram 51 is forced forward rotating the entire assembly including dome 11. The positional accuracy of the mechanism can be determined in many ways, one of which can be mounting a magnetic pickup 99 within activator 90 for sensing the rotation of magnet 79. The position of tram 51 can also be determined by installing a small light source and a photodetector or any other detecting device.

Dome 11 may also be rotated by other mechanical means. FIG. 11 shows a taut flexible belt 1102 engaging the outside perimeter of dome 11 through interlocking grooves or by friction. The belt also passes around the rotating shaft of a motor 1102. FIG. 12 shows a motor linked directly to dome 11. Motor 1201 is located directly adjacent to the circumference of dome 11 and interlocking gears 1202 and 1203 synchronize motor 1201 and dome 11.

Although this description describes the invention with reference to the above specified embodiments, the claims and not this description limited the scope of the invention. Various modifications of the disclosed embodiment, as well as alternative embodiments of the invention, will become apparent to persons skilled in the art upon reference to the above description. Therefore, the appended claims will cover such modifications that fall within the true scope of the invention.

What is claimed is:

1. A system for rotating a dome, said system comprising:

a dome having a circumferential edge for controlling said rotation;

a stationary member having included therein a cushioning member which cushioning member is fluid controlled, said stationary member having a radius of curvature matching the radius of curvature of said circumferential edge;

a movable member slidably engaged to said stationary member and responsive to fluid directed to said movable member for moving along said curved radius of said stationary member under control of said fluid; and a coupling member for connecting said circumferential edge of said dome to said movable member.

2. The system set forth in claim 1 further comprising a plurality of said movable members positionally spaced along said circumferential edge of said dome.

3. The system set forth in claim 2 wherein said stationary member defines a complete circle.

4. The system set forth in claim 3 further comprising:

a position determining member for signalling a rotational position of at least one of said movable members around said circle.

5. The system set forth in claim 4 wherein said fluid is controllable to control the rotational speed of said dome around said circle.

6. A method of rotating a dome having a circumferential edge for controlling said rotation, said method comprising the steps of:

positioning in a circle a stationary member having included fluid for supporting a movable member, said circle having a radius matching the radius of curvature of said circumferential edge;

selectively applying fluid to said movable member to move said movable member along said stationary member; and connecting said circumferential edge of said dome to said movable member.

7. The method set forth in claim 6 further comprising the step of:

positionally spacing a plurality of said movable members along said circumferential edge of said dome.

8. The method set forth in claim 7 further comprising the step of:

signalling a rotational position of at least one of said movable members around said circle.

9. A system for rotating a screen, comprising:

a dome with said screen fused to the inside of said dome;

a circumferential support structure for suspending said dome;

a system for rotating said dome;

a circular channel of said circumferential support structure attached to the bottom of said dome;

a stationary circular gas chamber slidably engaged with said channel and in fluid connection with a reservoir of gas;

said chamber having a radius of curvature and a cross-section matching said channel;

a gas gap between said channel and said chamber; and a plurality of holes in said chamber for releasing gas into said gas gap.

10. The system of claim 9 where said chamber and channel are rectangular in cross-section.

11. A system for rotating a screen, comprising:

a dome with a screen fused to the inside of said dome, said dome having a circumferential edge with a radius of curvature;

a stationary member in relation to which said dome is operable to rotate, said stationary member including:

means near said circumferential edge of said dome for suspending the weight of said dome such that said circumferential edge is free to rotate with respect to said stationary member, and a system imparting rotational force to said dome directly to points near said circumferential edge of said dome comprising a plurality of buckets mounted to said dome in a common plane around said dome; and a stationary activator for receiving and directing air against an open end of each of said buckets.

12. The system of claim 11 further comprising:

a plurality of activators spaced around the circumferential edge of said dome.

13. A rotating screen for viewing images in three dimensions, comprising:

a dome having a circumferential edge with a radius of curvature;

a screen fused to the inside of said dome;

a stationary member in relation to which said dome is operable to rotate, said stationary member including:

suspending structure near said circumferential edge of said dome for suspending the weight of said dome such that said circumferential edge is free to rotate with respect to said stationary member, and a system imparting rotational force to said dome directly to points closely adjacent said circumferential edge of said dome; and a monitor for monitoring the rotation of said dome.

14. The system of claim 13 wherein said monitor comprises a stationary sensor sensitive to light reflected off of said rotating dome.

15. The system of claim 13 wherein said monitor comprises a stationary sensor sensitive to magnetic fields generated by the rotating dome.

16. A method of viewing images in three dimensions comprising the steps of:

providing a screen;

fusing an outer edge of said screen to the inside of a dome;

providing a circular channel below said dome;

supporting said dome over a chamber in fluid connection with an air reservoir;

said chamber having a cross-section and a radius of curvature matching said channel;

creating a cushion of air between said channel and said activator by expelling air through a plurality of holes in said chamber;

creating a plurality of buckets along the edge of said dome;

positioning a plurality of activators in fluid connection with an air reservoir adjacent to and directed toward said buckets; and rotating said dome and said screen by expelling air through said activators against said buckets.

17. The method of claim 16 further comprising the step of monitoring the rotation of said dome.

18. The method of claim 17 wherein said monitoring step includes the step of positioning a stationary sensor sensitive to light reflected off of said rotating dome adjacent to said dome.

19. The device of claim 17 wherein said means to monitor comprises a stationary sensor sensitive to magnetic fields generated by the rotating dome.

20. A system for rotating a screen, comprising:

a dome with a screen fused to the inside of said dome, said dome having a circumferential edge with a radius of curvature;

a stationary member in relation to which said dome is operable to rotate, said stationary member including:

means near said circumferential edge of said dome for suspending the weight of said dome such that said circumferential edge is free to rotate with respect to said stationary member, operable to create and air cushion between said stationary member and said dome; and a system imparting rotational force to said dome directly to points near said circumferential edge of said dome.

21. A system for rotating a dome, said system comprising:

a movable dome having a circumferential edge for controlling said rotation;

a stationary member for supporting said dome, means for cushionably displacing said dome off of said stationary member, said means for cushionably displacing having a radius of curvature matching the radius of curvature of said circumferential edge;

fluid directing means affixed to said stationary member for directing fluid; and a movable member affixed to said dome and responsive to fluid directed from said fluid directing means to said movable member for imparting rotational force to said dome.

22. The system of claim 21, wherein said means for cushionably displacing is operable to create a fluid cushion between said dome and said stationary member.

* * * * *